US007258250B2

(12) United States Patent
Baudin

(10) Patent No.: US 7,258,250 B2
(45) Date of Patent: Aug. 21, 2007

(54) RECEPTACLE HAVING A REINFORCED WALL

(75) Inventor: Gilles Baudin, Domont (FR)

(73) Assignee: L'Oreal (FR)

( * ) Notice: Subject to any disclaimer, the term of this patent is extended or adjusted under 35 U.S.C. 154(b) by 159 days.

(21) Appl. No.: 10/645,430

(22) Filed: Aug. 21, 2003

(65) Prior Publication Data

US 2004/0074860 A1 Apr. 22, 2004

Related U.S. Application Data

(60) Provisional application No. 60/412,783, filed on Sep. 24, 2002.

(30) Foreign Application Priority Data

Aug. 21, 2002 (FR) ..... 02 10450

(51) Int. Cl.
*B65D 35/00* (2006.01)

(52) U.S. Cl. ..... 222/92; 220/608

(58) Field of Classification Search ..... 222/92, 222/153.14; 215/216, 376, 372; 220/605–609, 220/613, 623, 624, 628
See application file for complete search history.

(56) References Cited

U.S. PATENT DOCUMENTS

| | | | | |
|---|---|---|---|---|
| 2,717,726 | A | | 9/1955 | Mart |
| 3,029,003 | A | | 4/1962 | Gronemeyer |
| 3,258,179 | A | | 6/1966 | Chera |
| 3,690,521 | A | | 9/1972 | Middleton |
| 3,848,779 | A | * | 11/1974 | Stull ..... 222/521 |
| 3,900,123 | A | * | 8/1975 | Darlington ..... 222/153.14 |
| 3,993,208 | A | * | 11/1976 | Ostrowsky ..... 215/216 |
| 4,308,979 | A | | 1/1982 | Oterson |
| 4,600,127 | A | | 7/1986 | Malpas et al. |
| 4,793,491 | A | * | 12/1988 | Wolf et al. ..... 206/509 |
| 4,949,861 | A | | 8/1990 | Cochran |
| 4,961,515 | A | | 10/1990 | Schreiber |
| 5,160,057 | A | * | 11/1992 | Fitjer ..... 215/216 |
| 5,246,148 | A | | 9/1993 | Slat et al. |
| 5,303,850 | A | | 4/1994 | Connan |
| 5,358,146 | A | | 10/1994 | Stull |
| 5,377,858 | A | * | 1/1995 | Morris, Sr. ..... 215/216 |
| 5,582,315 | A | | 12/1996 | Reid |
| 5,597,085 | A | * | 1/1997 | Rauworth et al. ..... 220/581 |
| 5,687,863 | A | * | 11/1997 | Kusz ..... 215/216 |
| 5,833,115 | A | | 11/1998 | Eiten |
| 6,176,395 | B1 | * | 1/2001 | Abbott et al. ..... 222/94 |
| 6,334,556 | B1 | | 1/2002 | Bougamont et al. |
| 6,378,735 | B1 | | 4/2002 | Chu |
| 6,398,052 | B1 | | 6/2002 | Cheng et al. |

FOREIGN PATENT DOCUMENTS

FR 2 449 045 A1 9/1980

* cited by examiner

*Primary Examiner*—Lien M. Ngo
(74) *Attorney, Agent, or Firm*—Lerner, David, Littenberg, Krumholz & Mentlik, LLP

(57) ABSTRACT

The present invention provides a receptacle made by molding in a mold defining a join plane. The receptacle includes a body with an end wall having a periphery and a neck connected to the end wall. The end wall has at least one step extending along the join plane over at least a major part of a distance between the neck and the periphery of the end wall.

22 Claims, 3 Drawing Sheets

RECEPTACLE HAVING A REINFORCED WALL

CROSS-REFERENCE TO RELATED APPLICATIONS

This application claims the benefit of U.S. Provisional Application No. 60/412,783 filed on Sep. 24, 2002.

BACKGROUND OF THE INVENTION

For reasons of ecology and cost, it is desirable for the walls of receptacles made by molding a plastic material, in particular by blow molding, to be as thin as possible. Thereby reducing materials costs, while nevertheless presenting sufficient strength so as to enable a dispenser head to be mounted on the neck in a manufacturing line that is operating at a high rate of throughput.

In order to improve the strength of a receptacle, it is already known to make concentric tiers in the end wall to which the neck is connected. That solution presents the drawback of significantly increasing the size of the receptacle and it does not eliminate the risk of the top portion of the receptacle deforming in concertina-like manner if the applied force is excessive.

Other solutions have also been proposed, in particular for receptacles in which the body is elliptical in cross-section, which solutions consist, for example, in providing ribs that extend along the minor axis of the end wall.

SUMMARY OF THE INVENTION

There exists a need to further improve the ability of a receptacle to withstand an axial force exerted along the axis of its neck, without excessively complicating manufacture of the receptacle.

In one of its aspects, the present invention thus provides a receptacle made by molding in a mold defining a join plane. The receptacle includes a body with an end wall, and a periphery. A neck is connected to the end wall.

The receptacle is characterized by the fact that the end wall includes at least one step extending in the join plane over at least a major part of a distance between the neck and the periphery of the end wall. The term "major part" means at least half.

The presence of such a step, which can easily be achieved since it lies in the join plane, reinforces the strength of the end wall. In particular, the end wall is strengthened against stresses exerted axially while attaching a dispenser device on the neck, which attaching can be performed by snap-fastening, for example.

For equivalent strength, the present invention makes it possible to reduce the thickness of material or to use a material of lower intrinsic strength. For equal thickness of material, the present invention enables the receptacle to withstand higher levels of stress, thus making it possible to increase rates of manufacturing throughput.

The invention is particularly suitable for receptacles in which the body is made by blowing plastic material. This is due to the step being located in the region of the join plane, thereby making it easy to blow and to unmold the receptacle. Finally, the step serves to reinforce the receptacle without significantly increasing its size.

In a particular embodiment, the receptacle body presents a cross-section that is oblong with a major axis that is contained in the join plane. The above-mentioned step may extend from the neck towards the periphery of the end wall, on at least one side of the neck, and preferably on both sides of the neck. In a variant, or better in addition, the step extends from the periphery of the end wall towards the neck on at least one side of the neck, and preferably on both sides of the neck.

In addition to the reinforcement constituted by the above-mentioned step, the end wall may advantageously include at least one portion in relief, for example another step, a rib, and/or a groove, extending perpendicularly to the join plane.

In an additional embodiment of the present invention, the end wall has at least one rib extending from its periphery all the way to the join plane. Also a groove extends in line with the rib from the join plane towards the periphery.

The receptacle may further include two ribs extending on the end wall, each on a respective side of a midplane of the receptacle body and perpendicular to the join plane. These two ribs may connect with the neck and may present a height that increases as the ribs approach the neck.

In an additional embodiment of the present invention, the receptacle has four regions, each occupying substantially one-fourth of the end wall. Any two adjacent regions may have different axial positions as measured along the axis of the neck. Two regions that are diametrically opposite each other about the axis of the neck may have substantially the same axial position. Two adjacent regions may form a step between each other on a given side of the join plane. This step may be situated in a midplane perpendicular to the join plane and containing the axis of the neck. This further reinforces the strength of the end wall.

In an additional embodiment of the present invention, the step extending along the join plane may be formed between two regions of the end wall. These regions form between them an angle when the receptacle is observed in a direction perpendicular to the join plane. At its periphery, the end wall may present a ledge. The neck may be provided with an annular bead, e.g. for the purpose of enabling a dispenser device to be fixed on the receptacle by snap-fastening. Furthermore, the receptacle may be symmetrical in shape about an axis of symmetry, which axis may coincide with a longitudinal axis of the receptacle.

BRIEF DESCRIPTION OF THE DRAWINGS

The invention can be better understood on reading the following detailed description of non-limiting embodiments of the invention, and on examining the accompanying drawings, in which.

DETAILED DESCRIPTION

Figure 1:
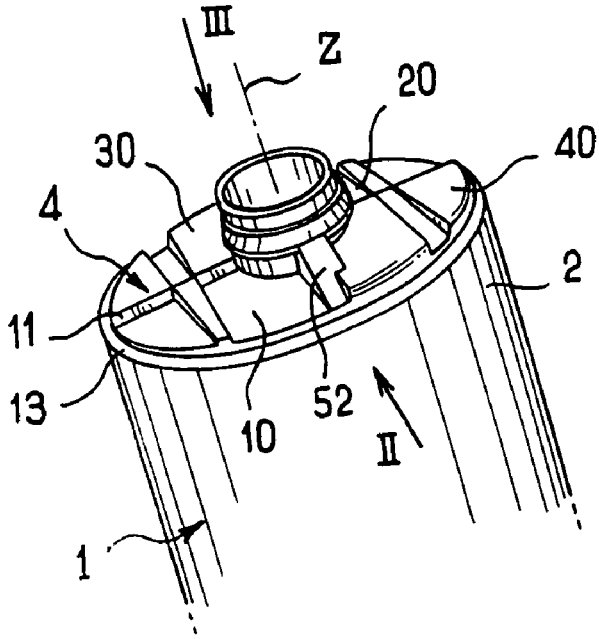
FIG. 1 is a perspective view showing in isolation, part of a receptacle constituting a first embodiment of the present invention.
Figure 2:
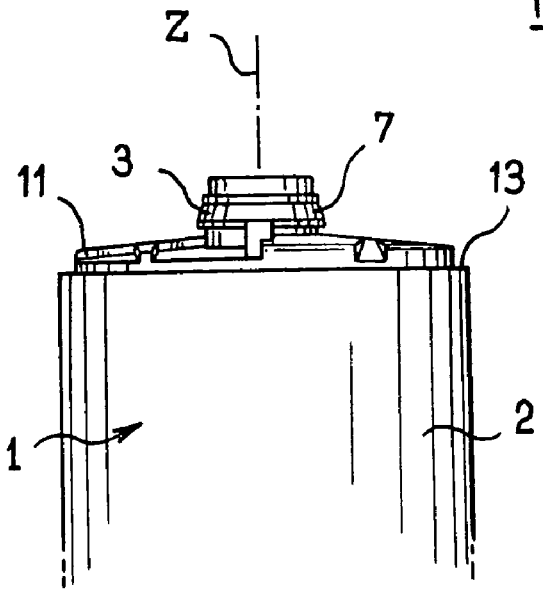
FIG. 2 is a fragmentary front view of the first embodiment of the present invention.
Figure 3:
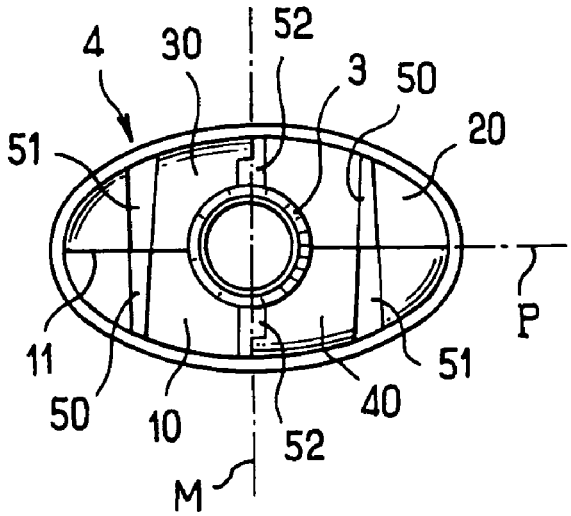
FIG. 3 is a top view of the first embodiment of the present invention.

FIGS. 1 to 3 show a receptacle 1 made by molding a thermoplastic material, for example a polyolefin such as polyethylene or polypropylene.

The receptacle 1 includes an elongate body 2 and a neck 3 on an axis Z which coincides with the longitudinal axis of the body 2 in the example described. The base of the neck 3 is connected to an end wall which constitutes the top wall 4 of the body 2 and the shoulders of the receptacle. The bottom end of the receptacle is closed by a bottom wall (not shown in the drawings) that is substantially plane and perpendicular to the axis Z, such that when the receptacle 1 is standing on a horizontal plane surface, the axis Z is vertical.

The body 2 may present a cross-section that is generally oblong in shape, being elliptical in the example shown. The top wall 4 of the receptacle 1 also presents an elliptical outline and extends generally transversely to the axis Z of the neck.

In the example described, the receptacle 1 may be made by blowing a plastic material in a mold that is comprised of two portions. A join plane P of the mold contains the major axis of the cross-section of the body 2 and that of the top wall 4. The existence of the join plane P may be visible on the body 2 of the receptacle in the form of a bead of material projecting very slightly on its outside surface. The minor axis of the top wall 4 is contained in a midplane M perpendicular to the join plane P and containing the axis Z of the neck, as can be seen in FIG. 3.

A step 11 is formed in the join plane P in order to create a portion in relief constituting a kind of "beam" stiffening the top wall 4.

In the example described, step 11 extends over more than half the length of the gap between the neck 3 and the periphery of the top wall 4. More precisely it extends from the periphery of the top wall 4, which includes a ledge 13. Step 11 extends all the way to the base of the neck 3, and defines part of the boundaries between four regions 10, 20, 30, and 40 of the top wall 4. The regions may be referred to as half-shoulders.

Each region 10, 20, 30, and 40 occupies substantially one-fourth of the top wall 4. Each fourth being defined by the intersection of a half-plane situated on one side of the join plane P and a half-plane situated on one side of the midplane M.

The two regions 10 and 20 are situated diametrically opposite each other about the axis Z and occupy substantially the same axial position along the axis Z. The regions 30 and 40 are likewise situated diametrically opposite each other about the axis Z and are offset axially relative to the regions 10 and 20. Regions 10 and 20 are closer to the free end of the neck 11, by a distance which corresponds substantially to the height of the step 11, as measured parallel to the axis Z. The top wall 4 may also has portions in relief extending transversely to the join plane P.

More particularly, in the example described, the top wall 4 may have two ribs 50 that are symmetrical to each other about the axis Z and that extend respectively in the regions 10 and 20. These ribs 50 have longitudinal axes parallel to the midplane M. The ribs 50 present a height as measured parallel to the axis Z, which increases linearly from a value that is substantially zero to a height substantially equal to step 11, as the ribs approach step 11. Ledge 13 is located at the periphery of the top of wall 4 and the height of the ribs being substantially zero is drawn in relation to the ledge Their width may increase slightly as ribs 50 approach step 11.

The top wall 4 may also have two grooves 51 situated in line with ribs 50 respectively. Each groove 51 has a longitudinal axis which extends along a direction that is generally perpendicular to the join plane P. The depth of the grooves 51 may increase linearly as grooves 51 extend away from the step 11.

The width of each groove 51 may increase slightly upon approaching the periphery of the top wall 4. The longitudinal edges of the grooves 51 are rectilinear and situated in line with the likewise rectilinearly longitudinal edges of the ribs 50 when the top wall 5 is observed from above, as can be seen in FIG. 3.

The top wall 4 may have two ribs 52 that are diametrically opposite about the axis Z, extending perpendicularly to the join plane P between the neck 3 and the periphery of the top wall 4 in the region of the minor axis thereof.

The height of the ribs 52 measured parallel to the axis Z increases linearly as ribs 52 approach neck 3 from a value that is substantially zero at the periphery of the top wall 4. Once again reference is chosen from the periphery of the top wall 4 here.

Apart from the presence of the ribs 50 and 52 and the grooves 51, the regions 10, 20, 30, and 40 are substantially plane.

Naturally, the receptacle may present reinforcement structures made in some other manner without going beyond the ambit of the present invention.

Figure 4:
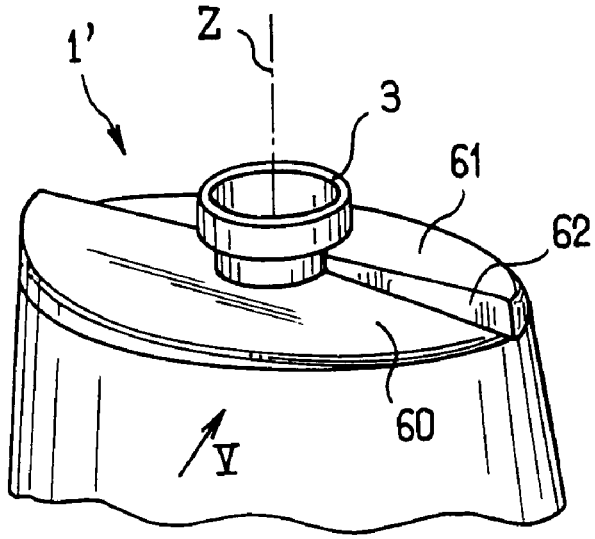
FIG. 4 is a fragmentary perspective view of a receptacle constituting a second embodiment of the present invention.

By way of example, FIG. 4 shows a receptacle 1' in which the top wall comprises two flats 60 and 61. Each flat occupying substantially half of the top wall and situated respectively on either side of the join plane. When the receptacle is observed in a direction perpendicular to the join plane P, each of the flats 60 and 61 makes a different angle relative to the axis Z of the neck 3 so as to form between them a step 62.

In this example, the top wall is elliptical in outline with its major axis being contained in the join plane.

Figure 5:
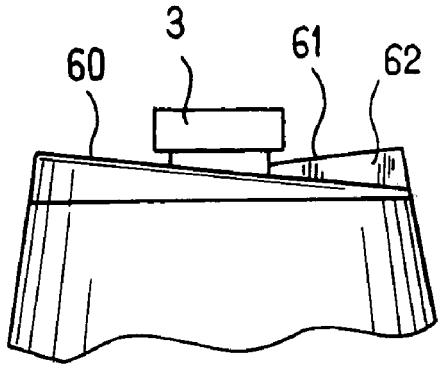
FIG. 5 is a fragmentary front view of the second embodiment of the present invention.

The flat 60 slopes downwards moving from right to left, as can be seen in FIG. 5, whereas flat 61 slopes upwards moving from left to right with reference to FIG. 5. The height of the step 62, as measured parallel to the axis Z thus decreases from the periphery of the top wall of the receptacle, as the step approaches the neck 3.

Figure 6:
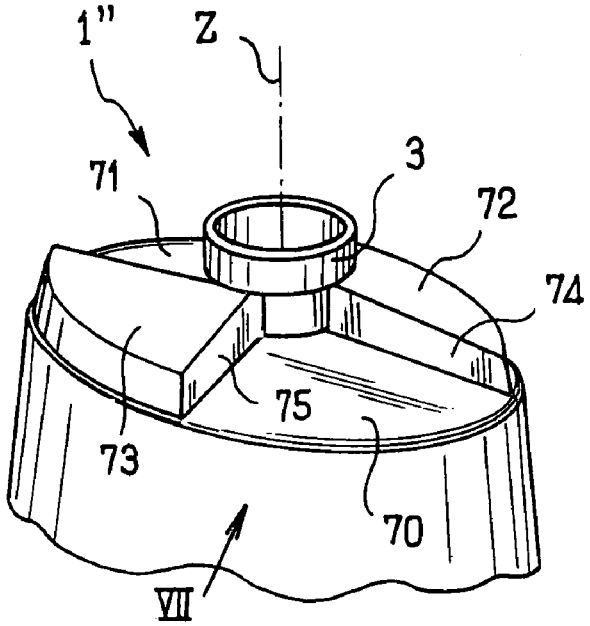
FIG. 6 is a fragmentary perspective view of an additional embodiment of the present invention.
Figure 7:
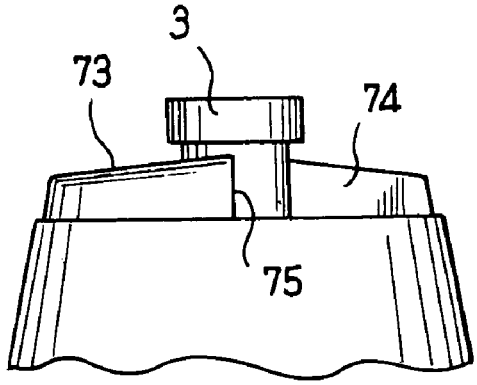
FIG. 7 is a fragmentary front view of the embodiment in FIG. 6.
Figure 9:
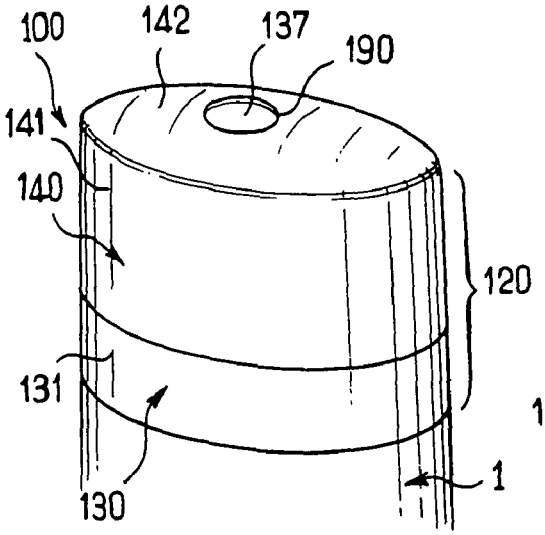
FIG. 9 is a diagrammatic perspective view of the dispenser device.
Figure 12:
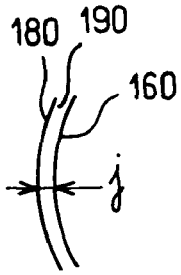
FIG. 12 is a fragmentary diagrammatic view of the dispenser orifice seen from above on a larger scale.
Figure 8:
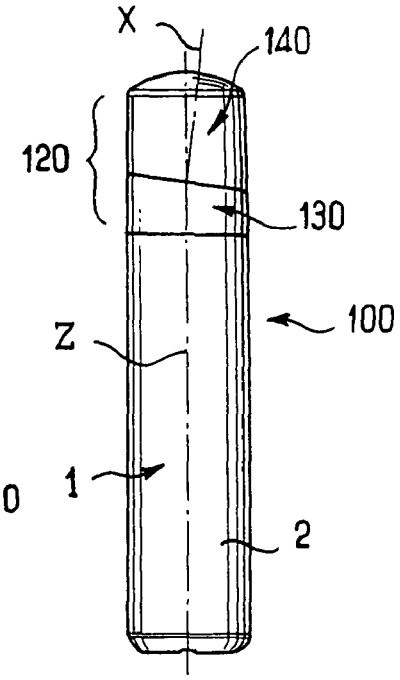
FIG. 8 is an elevation view of the embodiment of FIG. 1.

As shown in FIGS. 6 and 7, it is also possible to make the reinforced top wall with quarters that form steps between one another.

In FIG. 6, there is shown a receptacle 1" having four regions 70, 71, 72, and 73 each occupying one-fourth of the top wall of the receptacle.

In the example described, as in the preceding examples, the top wall presents an elliptical outline having its major axis contained in the join plane.

The regions 70 and 73 are situated on one side of the join plane, while the regions 71 and 72 are situated on the other side of the join plane. Region 71 is diametrically opposite region 70 and region 72 is diametrically opposite the region 73. The regions 70 and 71 are substantially plane and occupy the same axial position measured along the axis Z of the neck 3. The regions 72 and 73 are offset towards the free end of the neck 3 compared with the regions 70 and 71, such that steps are formed between each region 70 or 71 and the adjacent regions 72 and 73.

FIG. 6 shows a step 74 which is formed between the regions 70 and 72 in the join plane P, and a step 75 which is formed between the regions 70 and 73 in the midplane perpendicular to the join plane and containing the axis Z. The presence of the steps 74 and 75, and the presence of similar steps that are symmetrical about the axis of the neck 3 (not shown in the figures) and that are formed between the regions 71, 72, and 73 serve to reinforce the strength of the top wall against forces exerted along the axis Z. The invention thus makes it possible to make a receptacle whose top wall presents a relatively thin thickness of material while nevertheless being capable of withstanding assembly of a dispenser device on the receptacle by snap-fastening. An example of such a dispenser device is described below with reference to FIGS. 8 to 12.

The dispenser device 120 shown in the figures comprises two parts, a first part 130 for being fixed by snap-fastening on the receptacle 1, and a second part 140 capable of turning in either direction relative to the first part 130 about a pivot axis X which is at an angle of a little less than 10° relative to the axis Z in the example described. The first and second parts 130 and 140 may made of non-elastomeric plastics materials, of different colors.

Figure 11:
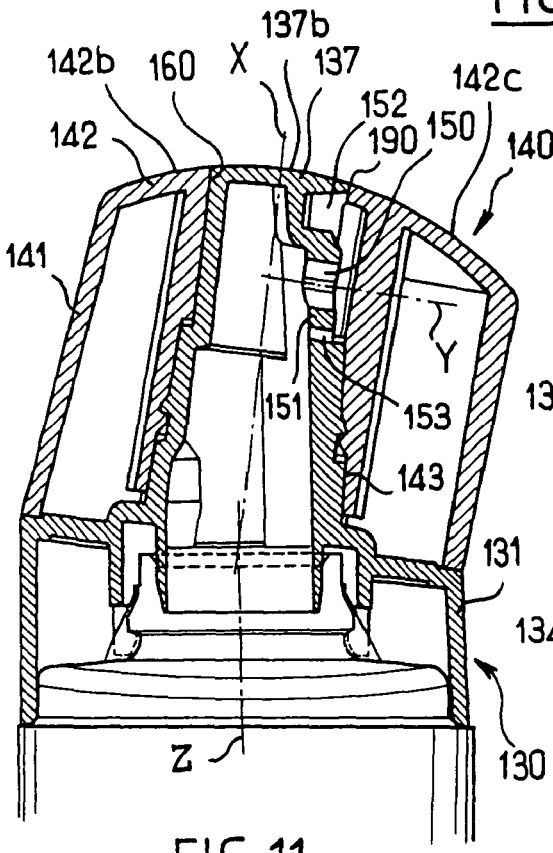
FIGS. 10 and 11 are diagrammatic axial section views of the dispenser device respectively in a closed position and in an open position.
Figure 10:
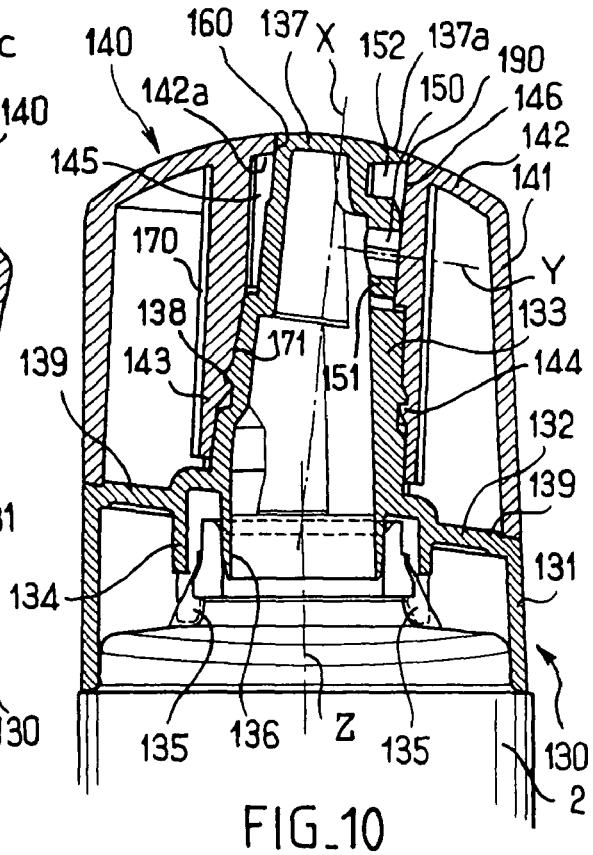

As can be seen in FIGS. 10 and 11, in particular, the first part 130 comprises a tubular outer skirt 131 designed to take up a position in which it extends around the outside surface of the body of the receptacle 1. A transverse wall 132 extending generally perpendicularly to the axis X is located adjacent the top of the outer skirt 131 inwards and supports extension 133. Extension 133 tubular about the axis X and has its base connected to the transverse wall 132.

The first part 130 also may include an assembly skirt 134 extending inside the outer skirt 131 and may have two teeth 135 on its radially inner surface in the form of circular arcs. Teeth 135 are for attaching to an annular bead 7 of the neck 3. A sealing lip 136, for pressing against the radially inner surface of the neck 3, extends extension 133 downwards. Annular bead 138 is formed on extension 133, and the top end of the extension is closed by end wall 137. The extension 133 has a lateral opening 150 defined by an annular lip 151 of axis Y perpendicular to the axis X. The annular lip 151 extends from a setback 152. Annular slot 153 is formed around the annular lip 151 in the setback 152. The top of the setback is defined by a portion 137*a* of the end wall 137. In the example described, the end wall 137 presents an edge which is circular about the axis X and which defines a cylindrical surface 160 having generator lines parallel to the axis X.

Second part 140 has an outer skirt 141 which surrounds the extension 133 and which is connected to a top wall 142.

The transverse wall 132 has two thin splines 139 extending parallel to the minor axis of the transverse wall 132. These two splines 139 are designed to co-operate with axial ribs (not shown in the drawings) on the radially inner surface of the outer skirt 141. This creates a hard point when turning the second part 140 and thus makes it easier to position it as a continuation of the outer skirt 131 of the first part 130. The second part 140 also has an inner skirt 143 configured for affixing to the extension 133. For this purpose, the inner skirt 143 has an annular rib 144 configured to snap onto the annular bead 138. On its radially inner surface, the inner skirt 143 presents a notch 145 which extends axially and which is of width slightly greater than the outside diameter of the annular lip 151. The top of the notch 145 is defined by a portion 142*a* of the top wall 142. Outside the notch 145, the inner skirt 143 presents a circularly cylindrical inside surface 146 about the axis X. The annular lip 151 presses in leaktight manner against inside surface 146 when the dispenser device is in the closed position, as can be seen in FIG. 10, thereby closing the lateral opening 150. The inside skirt 143 and the extension 133 have respective slightly-conical surfaces 170 and 171 which provide assembly sealing between the second part 140 and the first part 130 so as to prevent any substance from running downwards between the extension 133 and the inside skirt 143.

The top wall 142 presents an opening whose edge is circular about the axis X in the example described. The edge defining a cylindrical surface 180 whose generator lines are parallel to the axis X. The surface 180 co-operates with the facing surface 160 of the end wall 137 to define an annular space having an angular sector defining a dispenser orifice 190 opening directly to the outside and through which substance can leave the dispenser device.

In the example described, the spacing between the facing surfaces 160 and 180 is of substantially constant width j, regardless of whether or not the substance is dispensed. However it would not go beyond the ambit of the present invention for this spacing to vary circumferentially.

As can be seen in FIGS. 10 and 11, top wall 142 and the end wall 137 present respective top surfaces 142*b* and 137*b* which extend towards another (ignoring the annular gap between them), thus making it easier to clean the vicinity of the dispenser orifice 190.

The dispenser device operates as follows. In the closed position, the lateral opening 150 is closed by the inner skirt 143 so that the dispenser orifice 190 is not in communication with the inside of the receptacle 1. A user can bring the dispenser device into the dispensing position by causing the second part 140 to turn through half a turn relative to the first part 130. This turning movement brings the notch 145 of the inner skirt 143 into register with the setback 152, thereby creating a chamber enabling the substance to flow from the lateral orifice 150 towards the dispenser orifice 190.

The substance can then flow towards the outlet, e.g. under drive from pressure exerted on the deformable wall 2 of the receptacle 1 seeking to reduce its inside volume, or by turning the receptacle over so that its head points downwards, if the substance is sufficiently fluid.

On examining FIG. 11, it can be seen that in the dispensing position, the outer skirt 141 of the second part 140 forms an angle with the outer skirt 131 of the first part 130, thus enabling a user to see more clearly that the dispenser device has changed state.

Once dispensing is finished, ingress of air can take place because of the shape memory of the body 2 of the receptacle 1, for example. Given the small spacing that exists between the end wall 137 and the top wall 142, any substance present in the dispenser orifice 190 can be sucked back in.

Naturally, the present invention is not limited to the embodiment described above. The cross-section of the receptacle body could be circular, for example. A dispenser device other than that described with reference to FIGS. 8 to 12 could be affixed on the receptacle.

Throughout the description, including in the claims, the term "comprising a" should be understood as being synonymous with "comprising at least one" unless specified to the contrary.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

The invention claimed is:

1. A receptacle comprising:

a body, said body comprising an end wall, said end wall having a periphery, said body comprising a join plane extending across said end wall; and a neck having an axis, said neck connected to said end wall, wherein said end wall comprises at least one step, said step extending in a direct of said join plane over at least a major part of the distance between said neck and said periphery of said end wall, said end wall further comprising at least one rib, said rib extending the entire distance from said periphery to said join plane, said end wall further comprising at least one groove, said groove extending adjacent to said rib from said join plane towards said periphery.

2. A receptacle according to claim 1, wherein said body has a cross-sectional shape that is oblong, said cross-sectional shape having a major axis contained in said join plane.

3. A receptacle according to claim 2, wherein said oblong cross-sectional shape is elliptical.

4. A receptacle according to claim 1, wherein said step extends from said neck towards said periphery on at least one side of said neck.

5. A receptacle according to claim 4, wherein said neck includes two sides, and wherein said at least one step comprises a pair of steps, and further wherein each of said pair of steps extends from said neck towards said periphery on each of said two sides of said neck.

6. A receptacle according to claim 1, wherein said step extends from said periphery towards said neck on at least one side of said neck.

7. A receptacle according to claim 6, wherein said neck includes two sides, and wherein said at least one step comprises a pair of steps, and further wherein each of said pair of steps extends from said periphery towards said neck on each of said two sides of said neck.

8. A receptacle according to claim 1, wherein said neck includes two sides, and wherein said at least one step comprises a pair of steps, and further wherein each of said steps extends from said neck all the way to said periphery on each of said two sides of said neck.

9. A receptacle according to claim 1, wherein said end wall includes at least one portion in relief, said portion extending perpendicularly to said join plane.

10. A receptacle according to claim 1, wherein said end wall includes two ribs, said ribs extending on said end wall, each of said ribs on a respective opposite side of a midplane of said body of the receptacle and each extending perpendicularly to said join plane.

11. A receptacle according to claim 10, wherein said two ribs interconnect with said neck.

12. A receptacle according to claim 10, wherein said two ribs have a height, said height increasing as said ribs approach said neck.

13. A receptacle according to claim 1, further including four regions, said regions each occupying substantially one-fourth of said end wall, and further wherein any two adjacent ones of said four regions retain axial positions as measured along an axis of said neck are different.

14. A receptacle according to claim 13, wherein two of said four regions which are diametrically opposite each other about said axis of said neck have substantially the same axial position.

15. A receptacle according to claim 13, wherein two of said four regions which are adjacent each other on the same side of said join plane form between them said step.

16. A receptacle according to claim 15, wherein said step is situated in a midplane of said body which is perpendicular to said join plane and includes said axis of said neck.

17. A receptacle according to claim 1, wherein said end wall includes at least two regions, and wherein said step is formed between said two regions of said end wall, said regions forming an angle between each other when the receptacle is observed in a direction perpendicular to said join plane.

18. A receptacle according to claim 1, wherein said end wall includes a ledge, said ledge being located at a periphery of said end wall.

19. A receptacle according to claim 1, wherein said neck includes an annular bead.

20. A receptacle according to claim 1, wherein the receptacle includes an axis of symmetry, and wherein the receptacle is symmetrical in shape about said axis of symmetry.

21. A receptacle according to claim 1, wherein the receptacle is formed by blowing a plastic material.

22. A receptacle according to claim 1, wherein the receptacle is provided with a dispenser device, said dispenser device being affixed onto said neck by snap-fastening.

* * * * *